US010072366B2

(12) United States Patent
Foss et al.

(10) Patent No.: US 10,072,366 B2
(45) Date of Patent: Sep. 11, 2018

(54) MOLDABLE AUTOMOTIVE FIBROUS PRODUCTS WITH ENHANCED HEAT DEFORMATION

(71) Applicant: Nonwoven Network LLC, Naples, FL (US)

(72) Inventors: Stephen W. Foss, Naples, FL (US); Jean-Marie Turra, Greer, SC (US)

(73) Assignee: Nonwoven Network LLC, Naples, FL (US)

( * ) Notice: Subject to any disclaimer, the term of this patent is extended or adjusted under 35 U.S.C. 154(b) by 494 days.

(21) Appl. No.: 14/633,578

(22) Filed: Feb. 27, 2015

(65) Prior Publication Data

US 2016/0122924 A1 May 5, 2016

Related U.S. Application Data

(60) Provisional application No. 62/072,305, filed on Oct. 29, 2014.

(51) Int. Cl.

| | |
|---|---|
| ***D02G 3/22*** | (2006.01) |
| ***D04H 1/541*** | (2012.01) |
| ***D04H 1/558*** | (2012.01) |
| ***D04H 1/435*** | (2012.01) |
| ***D04H 1/55*** | (2012.01) |

(52) U.S. Cl.

CPC ..... *D04H 1/541* (2013.01); *D04H 1/435* (2013.01); *D04H 1/55* (2013.01); *D04H 1/558* (2013.01); *D10B 2331/04* (2013.01); *D10B 2401/04* (2013.01); *D10B 2401/16* (2013.01)

(58) Field of Classification Search

CPC ..... D04H 1/541; D04H 1/435; D04H 1/55; D04H 1/558

USPC ..... 442/59

See application file for complete search history.

(56) References Cited

U.S. PATENT DOCUMENTS

| | | | |
|---|---|---|---|
| 3,607,602 | A | 9/1971 | Greskiewicz |
| 3,919,444 | A | 11/1975 | Shayman |
| 4,851,283 | A | 7/1989 | Holtrop et al. |
| 5,000,992 | A | 3/1991 | Kelch |
| 5,545,441 | A | 8/1996 | Land |

(Continued)

FOREIGN PATENT DOCUMENTS

| | | | |
|---|---|---|---|
| DE | 19808425 | A1 | 9/1999 |
| EP | 1013414 | A2 | 6/2000 |

(Continued)

OTHER PUBLICATIONS

Extended European Search Report for Application No. EP15162186 dated Jul. 21, 2016.

(Continued)

*Primary Examiner* — Vincent Tatesure

(74) *Attorney, Agent, or Firm* — Lerner, David, Littenberg, Krumholz & Mentlik, LLP

(57) ABSTRACT

Described are fibrous products for molding for use in Automotive products such as Underbody Aero-shields, wheel house liners, and Engine compartment applications with enhanced heat aging capability, abrasion resistance, and resistance to water, oils, and other fluids and is recyclable. The fibrous products also have acoustical benefits such as improved acoustical impedance or sound dampening properties over currently available acoustic insulation materials.

10 Claims, 4 Drawing Sheets

(56) References Cited

U.S. PATENT DOCUMENTS

| | | | | |
|---|---|---|---|---|
| 5,558,710 | A | 9/1996 | Baig | |
| 5,567,511 | A | 10/1996 | Shih et al. | |
| 6,475,315 | B1 | 11/2002 | Kean et al. | |
| 6,541,105 | B1 | 4/2003 | Park | |
| 6,855,753 | B1 | 2/2005 | Englert | |
| 6,877,585 | B2 | 4/2005 | Tinianov | |
| 8,173,233 | B2 | 5/2012 | Rogers et al. | |
| 8,337,976 | B2 | 12/2012 | Mayers et al. | |
| 8,496,088 | B2 | 7/2013 | Kitchen et al. | |
| 9,234,348 | B1 | 1/2016 | Lehane et al. | |
| 2004/0231915 | A1 | 11/2004 | Thompson et al. | |
| 2005/0003728 | A1 | 1/2005 | Foss | |
| 2005/0136100 | A1 | 6/2005 | Foss | |
| 2006/0065482 | A1 | 3/2006 | Schmidft et al. | |
| 2006/0137799 | A1 | 6/2006 | Haque et al. | |
| 2006/0141884 | A1 | 6/2006 | Haque | |
| 2006/0289231 | A1 | 12/2006 | Priebe et al. | |
| 2008/0067002 | A1 | 3/2008 | Pfaffelhuber et al. | |
| 2009/0242325 | A1 | 10/2009 | Dellinger et al. | |
| 2009/0246492 | A1 | 10/2009 | Bishop et al. | |
| 2009/0253323 | A1 | 10/2009 | Mueller et al. | |
| 2010/0112881 | A1 | 5/2010 | Bahukudumbi | |
| 2011/0114414 | A1 | 5/2011 | Bliton et al. | |
| 2011/0151738 | A1 | 6/2011 | Moore et al. | |
| 2011/0293911 | A1 | 12/2011 | Coates et al. | |
| 2012/0315225 | A1 | 12/2012 | Porbeni et al. | |
| 2013/0115837 | A1 | 5/2013 | Kitchen et al. | |
| 2013/0288556 | A1* | 10/2013 | Moore | D04H 1/435 442/334 |
| 2014/0079938 | A1 | 3/2014 | Perick et al. | |
| 2014/0242309 | A1 | 8/2014 | Foss et al. | |

FOREIGN PATENT DOCUMENTS

| | | | |
|---|---|---|---|
| EP | 2781636 | A1 | 9/2014 |
| EP | 2860294 | A1 | 4/2015 |
| WO | 0151546 | A1 | 7/2001 |
| WO | 0209089 | | 1/2002 |
| WO | 2007061423 | A2 | 5/2007 |
| WO | 2009088648 | A1 | 7/2009 |

OTHER PUBLICATIONS

Extended European Search Report for EP Application No. 15162188.5 dated Mar. 15, 2016.

Partial European Search Report for EP Application No. 15162186.9 dated Mar. 8, 2016.

Extended European Search Report for Application No. 16176357.8 dated Nov. 30, 2016.

Nonwoven Network, "Spotlight", retreived from <http://www.nonwovennetwork.com/docs/spotlight.htm>, printed on Feb. 25, 2015.

Tascan, "Effects of Fiber Denier, Fiber Cross-Sectional Shape and Fabric Density on Acoustical Behavior of Vertically Lapped Nonwoven Fabrics", Journal of Engineered Fibers and Fabrics, vol. 3, Issue 2, 2008, pp. 32-38.

Extended European Search Report for Application No. 15192094.9 dated Jul. 19, 2016.

Shahani, F., Soltani, P., et al., The Analysis of Acoustic Characteristics and Sound Absorption Coefficient of Needle Punched Nonwoven Fabrics, Journal of Engineered Fibers and Fabrics, vol. 9, Issue 2—2014.

* cited by examiner

MOLDABLE AUTOMOTIVE FIBROUS PRODUCTS WITH ENHANCED HEAT DEFORMATION

CROSS-REFERENCE TO RELATED APPLICATION

The present application claims the benefit of the filing date of U.S. Provisional Patent Application No. 62/072,305, filed Oct. 29, 2014, the disclosure of which is hereby incorporated herein by reference.

BACKGROUND OF THE INVENTION

Fibrous elements have long been used by the automotive industry to form moldable fiber products. These products may utilize knitted fabrics, woven fabrics, and nonwoven fabrics. Exemplary nonwoven fabrics may be needle punched, spun bonded, spun laced, thermally bonded, or chemically bonded.

Most thermally bonded nonwoven fabrics are made by intimately blending a high melt temperature fiber with a low melt temperature fiber. This allows the low melt temperature fiber to be melted during a heating process, such as thermoforming, to form a stiff, molded portion of the fabric. Thermoforming may be used, for example, to conform the molded portion to a surface of an automobile. Not all fibrous elements perform equally when heated. For example, most low melt temperature fibers have a glass transition temperature ("Tg") of less than 90° C.; many high melt temperature fibers are similarly limited. As a result, many nonwoven fabrics are limited to a maximum heat deformation temperature of 90° C.

While a deformation temperature of 90° C. or less is adequate for many interior applications, the advent of using fibrous products in exterior areas as well as near engine components has driven the need for higher heat deformation temperatures. For example, many automotive manufacturers are now demanding nonwoven fabrics with a heat deformation temperature of at least 120° C. Demands for nonwoven fabrics having a heat deformation temperature of 150° C. are also common.

A deformation temperature of 120° C. can be achieved by using Polypropylene ("PP") as the low melt temperature fiber. But PP starts to soften at 140° C. and fully melts at 165° C. Thus, PP cannot be used to meet a deformation temperature of 150° C. Polyester or Nylon may be used as high melt temperature fiber; however, they do not recyclable back into itself. Thus, neither the molding scrap nor the finished products are recyclable back into themselves for new production. Both of these challenges limit the usefulness of PP or Polyesters within moldable fabrics.

Excessive deformation is another concern. For example, deformation may be detrimental to vehicle safety if the molded portion is exposed to the exterior of the vehicle. Deformation of a molded exterior portion is also detrimental to the appearance of the vehicle and can create stress on the fastening systems. Thus, deformation resistance is also a performance requirement of any moldable fabric.

Bi-component fibers have also been used to make moldable fiber products. Typically, these fibers have a core-sheath configuration, wherein an exterior sheath formed from the low temperature melt fiber is coaxial with an interior core formed from the high temperature melt fiber. Some bi-component fibers may be adapted to have a heat deformation temperature greater than 150° C. For example, some bi-component fibers employ crystalline polymers that melt at 160-185° C. Yet even these "high temperature" fibers may not be ideal for use in a moldable fabric because, once melted, they revert to an amorphous structure with a Tg of 70-90° C. As a result, any moldable fabric made with existing bi-component fibers may suffer from excess deformation if exposed to temperatures greater than 90° C. Moreover, while most bi-component fibers can be recyclable, the recycling process may be greatly complicated by the bond between the exterior sheath and the interior core.

In addition to the performance requirements stated above, many moldable fiber products must also meet strict performance requirements for airflow, flexibility, flame resistance, smoke resistance, and durability. For example, some products must achieve a significant reduction in airflow (or increase in "Rayls," the measurement of airflow resistance) and have a flexural modulus optimized for strength and durability.

These additional requirements can be difficult to meet because many known fiber elements are porous. As a result, many existing products may distort and fail by absorbing (or adsorbing) water, oil, and other engine fluids.

This problem is related to flame and smoke resistance. For example, a product that is more likely to absorb oil is also less likely to be flame and smoke resistant; instead, such products are more likely to generate large amounts of smoke as the oil burns off during a fire.

Generally, most fibrous products will absorb or adsorb water, oil, and other engine fluids, which increase the weight which causes them to distort and fail. Further, there is a need to improve flame resistance to a much higher standard than the MVSS-302 test. There is also a need to reduce smoke generated for the safety of vehicle occupants in case of a fire.

A need exists for a product that does not exhibit failure during heat aging up to 150° C.; has resistance to water, oil, and engine fluids, has low flame spread and low smoke, and is recyclable back into itself. Further, these moldable products must have excellent abrasion resistance against sand & gravel.

Therefore, need exists for a moldable fabric adapted to meet the performance characteristics noted above. Further improvements are required.

SUMMARY OF THE INVENTION

The invention utilizes a low melt fiber made from a co-polyester where cyclohexane dimethanol (CHDM) has been substituted for some of the ethylene glycol normally polymerized with Purified Terephthalic Acid to produce Polyester polyethylene terephthalate (PET). The result is a polymer called PETG for a glycol modified PET polymer. The melting point of the PET polymer can be adjusted from 110° C. to 170° C. by adjusting the ratio of CHDM to ethylene glycol (EG).

Mono-component fibers are made from PETG using PET melt spinning equipment and are produced in a wide variety of deniers and lengths. The drying of the resin chips must be performed at below 70° C. with desiccant air and preferably with continuous agitation. The fibers are produced using a 4.5 inch extruder with metering pumps, 1500 hole round spinnerettes, and standard air quench. The spun fiber is drawn on a standard draw line with draw ratios between 2 and 3.5:1. The fibers may be cut to length from 0.5" to 4' and placed in a bale. The fibers remain completely amorphous after drawing unlike regular PET, which crystallizes.

The PETG fibers are blended with standard polyester fibers that are heat set to 170° C. and above. During blending fiber finishes such as Goulston L624 (fluorocarbon) may be applied during blending. Other finishes such as Lurol 14951 may be blended with L624 to achieve fire retardant characteristics. Anti-stats such as ASY are added to improve run ability especially with low humidity in manufacturing buildings.

The blended fibers were then carded, cross-lapped, and needled on a standard nonwoven line to form fabrics from 200 gsm to 2,000 gsm. These fabrics were subsequently molded in a standard thermos-forming operation. When the PETG melted it flowed uniformly and formed meniscus at the bond points of the high melt fibers. The level of the PETG percentage control the stiffness and the air flow resistance.

Fibers made from Polylactic Acid (PLA) such as fibers made from Cargill's PLA Ingeo polymer the have been drawn and fully crystallized with a melting point of 140° C. and above are blended with Polyester (PET) fibers that have been heat set at 170° C. or above.

DETAILED DESCRIPTION

Figure 1:
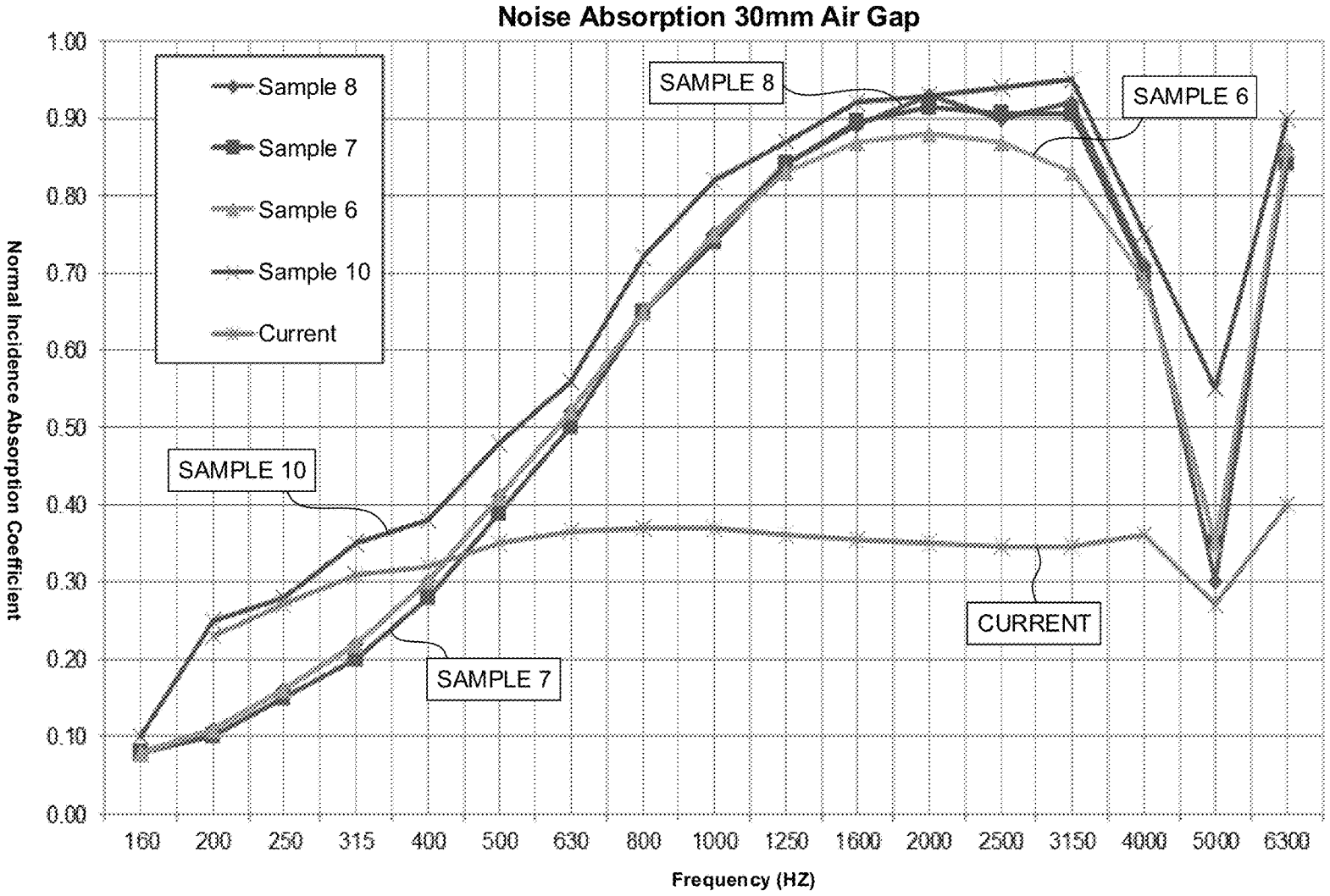
FIG. 1 show a graph comparing sound transmission of various moldable fabrics by measuring normal impedance absorption coefficient against Frequency.

Although the present invention is described with reference to specific embodiments of a moldable fabric for automotive applications, it is to be understood that the concepts and novelty underlying the present invention could be utilized for non-automotive applications. The present invention is also described with reference to a number of exemplary embodiments, some of which are described as having a particular range of values, such as temperature and the like. It should be further appreciated that these exemplary embodiments, and their associated numerical ranges, merely provide a convenient way of describing the present invention and are not intended to limit this description to any particular example or associated numerical range.

The present invention is directed to various embodiments of moldable fabric and methods for manufacturing the same. The fabric is comprised of a plurality of fiber elements. The moldable fabric may comprise any combination of low melt temperature fibers and high melt temperature fibers. Any portion of the plurality of fibers may also consist of monocomponent fibers, bi-component fibers, or any combination thereof.

In one embodiment, the moldable fabric comprises at least one low melt temperature fiber. Each low melt fiber is preferably made from a copolyester material formed by modifying a base material, such as ethylene glycol ("EG"). Preferably still, the copolyester material includes cyclohexanedimethanol ("CHDM"). For example, CHDM may be substituted for an amount of EG that is normally polymerized with purified terephthalic acid ("PTA") to produce polyester ("PET"). The resulting copolymer material is called polyethylene terephthalate glycol modified ("PETG"). As described fully below, the melting point of PETG can desirably be adjusted from 110° C. to 170° C. by adjusting the ratio of CHDM to EG. This makes PETG ideal for use as a low melt temperature fiber.

A moldable fabric in accordance with the present invention can also be made from biopolymer materials. For example, the low melt temperature fiber may alternatively be made with polyacid ("PLA") polymers. An exemplary PLA fiber may include any number of PLA polymers owned by Natureworks, LLC, and sold under the trademarked brand name of Ingeo®. Specific examples include the following fiber types: 6201D, 6202D, 6204D, 6400D, 3001D, 4032D, 4043D, and 4060D. Each of these PLA fibers have a heat deformation temperature of 140° C. and, thus—like many PETG fibers, may readily serve as the low melt temperature fiber.

Each low melt temperature fiber described above is blended with at least one high melt temperature fiber to form the moldable fabric. Each high melt fiber can be made of a polyester material. In each example set forth below, at least one PETG fiber is blended with a polyester fiber that has been heat set to a temperature that exceeds the melting point of the low melt temperature fiber. In some examples, the polyester fiber is heat set to approximately 175° C. or greater. The amount of PETG or PLA fibers controls the stiffness and the air flow resistance of the moldable fabric. Preferably, the percentage of PETG or PLA fiber in the moldable fabric is between 1% to 60% by weight.

Figure 3:
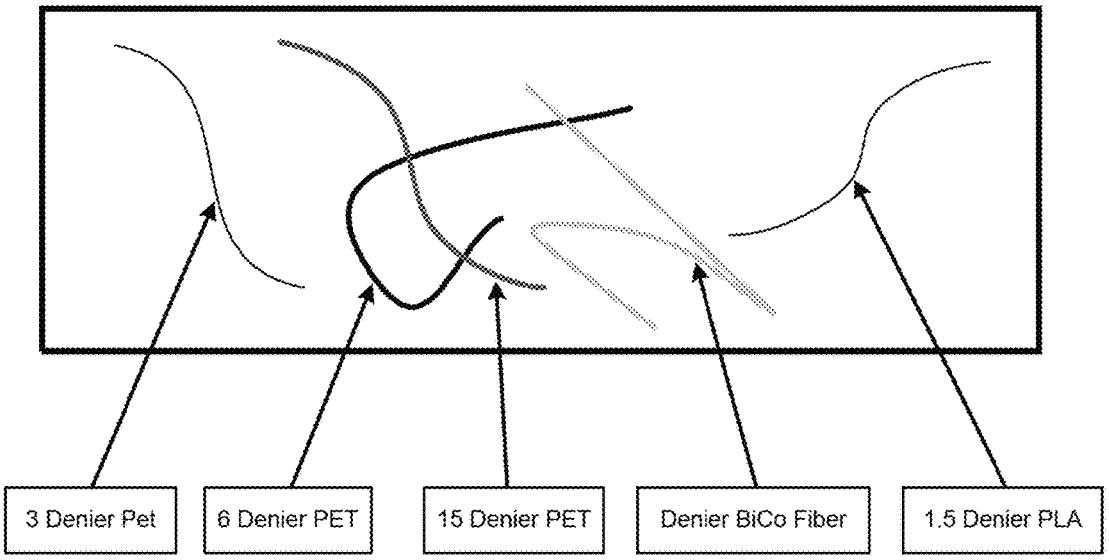
FIG. 3 shows relative sizes for five fibers used within some of the examples described herein.

Each of the low and high melt temperature fibers may be comprised of plurality of fiber types, each type having a variable color, denier, and length. Multiple low or high melt fiber types may also be combined. An exemplary set of fibers is depicted in FIG. 3, which corresponds to Examples 7 and 8 below. In FIG. 3, each fiber element has a denier per filament of between 1 to 15 and a maximum length of between 0.5 inches to 6 inches. An even greater variety of fiber types may also be formed using any combination of any fiber type described below in Examples 1-10.

Any PETG fiber element described herein can be made with known melt spinning equipment, including any known equipment that was originally adapted for use with PET. Known methods of manufacture, however, must be modified to accommodate the use of PETG. For example, a fiber element produced from either PET or PETG can be produced from resin chips. PETG resin chips must be dried at a temperature of less than 70° C. using desiccated air, preferably with continuous agitation. Once dried, then the PETG resin chips may be extruded to produce a spun PETG fiber. For example, the PETG chips may be extruded through a 4.5" extruder having at least one metering pump, a 1,500 hole round spinneret, and a standard air quench. The spun PETG fibers are then drawn on a standard draw line, cut to length, and then placed in a bale or like form. Unlike regular PET, which crystallizes, it should be appreciated that a PETG fiber element will remain completely amorphous after drawing.

In a preferred embodiment, the spun PETG fibers are drawn to have a minimum draw ratio of approximately 2 and a maximum draw ratio of approximately 3.5:1. The draw ratio may include any value intermediate of this range. For example, the draw ratio may range from approximately 2:1 to 3.5:1; from 2:1 to 3:1; from 2.5:1 to approximately 3.5:1; or any other intermediate range. Likewise, each fiber is preferably cut to have a minimum of length of approximately 0.5" and a maximum length of approximately 4'. Intermediate values of the draw length are also contemplated. For example, the length may range from approximately 0.5" to 6"; from 5" to 2'; from 1' to 3'; from 2' to approximately 6'; or any other intermediate range.

To produce a moldable fabric, the PETG fibers described above are typically blended with another fibrous element. As noted above, the PETG fibers may serve as the low melt temperature fiber, whereas another fibrous element serves as the high melt temperature fiber. Preferably, the PETG fibers are blended with polyester fibers that have been heat set to approximately 170° C. or more. The fibers are then carded, cross-lapped, and needled on a standard nonwoven line to form a moldable fabric. This blend typically has a minimum weight of 200 grams per square meter (or "GSM") and a maximum weight of 2,000 GSM. The fabric may also be blended to have any intermediate range of weights. For example, the blended fabric may have a weight that ranges from 200 to 2,000 GSM; from 200 to 500 GSM; from 400 to 1,000 GSM; from 500 to 1,500 GSM; or any other intermediate range.

Subsequent to blending, at least a portion of the moldable fabric may be formed into a molded portion by application of heat. The molded portion is preferably formed by heat that is applied with known thermoforming techniques. The amorphous nature of the PETG fibers is particularly suited to this process. For example, when the PETG fibers are melted, then the melted flows uniformly with respect to with the high melt temperature fibers to form a meniscus at each bond point with the high temperature melt fibers. This allows the molded portion to conform to any underlying shape without comprising the strength of the moldable fabric. Any known heating process may be used to achieve similar results. For example, the moldable fiber may be heated in any of a contact oven, an infrared oven, a convection oven, a like heating element, or a combination thereof.

Various elements of the manufacturing methods disclosed herein may be further modified to make alternate embodiments of the moldable fabric. For example, the percentage of PETG in each fiber element may be varied to control the stiffness of the molded portions. Because PETG flows in a uniform manner when melted, the percentage of PETG in each fiber may also be varied to control the air flow resistance of the fabric.

Additional materials may also be applied to any fibrous element described herein. For example, the PETG or PLA fibers described above may be treated with a performance enhancing finish, either during fiber formation or fiber blending. The finish types may vary. In some embodiments, the finish is comprised of a fluorocarbon, such as the CF fluorocarbon sold by Goulston Technologies as FC-L624. This enhances the durability and heat resistance of the moldable fabric. In other embodiments, the finish is comprised of an inorganic phosphate salt, such as that sold by Goulston Technologies as L-14951. This enhances the durability and heat resistance of the moldable fabric. In either instance, the performance enhancing finish preferably does not exceed 0.05% to 1.0% of the fiber weight. An alternate finish may also be comprised of a combination of a fluorocarbon and an inorganic phosphate salt to achieve fire retardant characteristics. Preferably, this alternate finish does not exceed 0.05% to 2.0% of the fiber weight. An anti-static element, such as ASY, may also be added to improve run ability, especially when the moldable fiber is manufactured within a low humidity environment.

Example 1

Historically, fiber blends at a weight of 1000 GSM were made using a combination of polyester and co-polyester fibers. A first sample in accordance with a historical blend comprises: (i) 65% of 6d×3" polyester fibers with a heat set of 175° C. (NwN Z201); and (ii) 35% of 4d×2" bi-component copolymer fibers with a PET internal core (Huvis). Once blended, this first sample was heated at 210° C. for 60 seconds, placed in cold mold for 60 seconds, and then trimmed to the shape of a trunk liner.

After aging at 90° C. for 24 hours, the first sample showed significant distortion. Water was immediately absorbed into the fabric during testing with 3 mL of water. All trim scrap was recyclable back into PET pellets.

Example 2

A second sample was produced at 1200 GSM using polypropylene as a binding agent. This blend of fibers in this second sample comprises, for example: (i) 60% of 6d×3" polyester fibers at with a heat set of 175° C. (NwN Z201); and (ii) 40% of 6d×3" black PP fibers (Drake Extrusion). Once blended, this second sample was heated at 210° C. for 60 seconds, placed in cold mold for 60 seconds, and trimmed to the shape of a wheelhouse liner.

After aging at 90° C. for 24 hours, this second sample showed very little deformation. Water was slowly absorbed into the fabric during testing with 3 mL of water. Trim scrap was not recyclable back into PET pellets.

Example 3

A third sample was produced at 1200 GSM using the following blend: (i) 60% of 6d×3" polyester fibers with a heat set of 175° C. (NwN Z201); (ii) 40% of 4d×2" bi-component copolymer fibers with a PET internal core (Huvis); (iii) 20% of 1.5d×1.5" PLA fibers (NwN 2438). Once blended, this third sample was heated at 210° C. for 60 seconds, placed in cold mold for 60 seconds, and then trimmed to the shape of an underbody aero shield.

After aging at 90° C. for 24 hours, the sample showed no distortion. Water was not absorbed into the fabric during testing with 3 mL of water. Trim scrap was recyclable back into PET pellets; however, this third sample showed inadequate flexural modulus and marginal noise reduction.

Example 4

A fourth sample was produced at 1350 GSM using the following blend: (i) 20% of 5d×3" polyester fibers with a heat set of 175° C. (NwN Z201); (ii) 20% of 15d×3" polyester fibers with a heat set of 175° C. (NwN Z202); (iii) 20% of 4d×2" polyester fibers with a heat set of 175° C. (NwN Z203); and 40% of 4d×2" bi-component copolymer fibers with a PET internal core (Huvis). Once blended, this fourth sample was heated at 210° C. for 60 seconds, placed in cold mold for 60 seconds, and trimmed to the shape of an underbody aero shield.

After aging at 90° C. for 24 hours, the sample showed some distortion. Water was absorbed into the fabric during testing with 3 mL of water. Trim scrap was recyclable back into PET pellets. This fourth sample desirably showed adequate flexural modulus and improved noise reduction.

Example 5

A fifth sample was prepared at 1350 GSM using the following blend: (i) 20% 6d×3" polyester heat set to 175° C. (NwN Z201); (ii) 20% 15d×3" polyester heat set to 175° C. (NwN Z202); (iii) 20% 3d×2" Polyester heat set to 175° C. (NwN Z203); and (iv) 40% of 4d×2" bi-component copolymer fibers with a PET internal core (Huvis). Once blended, this fifth was heated at 210° C. for 60 seconds, placed in cold mold for 60 seconds, and trimmed to the shape of an underbody aero shield.

After aging at 90° C. for 24 hours, the sample showed some distortion. Water was absorbed into the fabric during testing with 3 mL of water. Trim scrap was recyclable back into PET pellets. This fifth sample desirably showed adequate flexural modulus and improved noise reduction.

Example 6

A sixth sample was prepared at 1200 GSM using the following blend: (i) 20% of 6d×3" polyester heat set to 175° C. (NwN Z201); (ii) 20% of 15d×3" polyester heat set to 175° C. (NwN Z202); (iii) 20% of 3d×2" Polyester heat set to 175° C. (NwN Z203); (iv) 30% of 4d×2" bi-component copolymer fibers with a PET internal core (Huvis); and (v) 10% of 1.5d×1.5" PLA fibers (NwN 2438). Once blended, this sixth sample was heated at 210° C. for 60 seconds, placed in cold mold for 60 seconds, and then trimmed to the shape of an underbody aero shield.

After aging at 90° C. for 24 hours, the sample showed no distortion. Water was not absorbed into the fabric during testing with 3 mL of water. Trim scrap was recyclable back into PET pellets. This sixth sample desirably showed adequate flexural modulus and improved noise reduction.

Sample six was also tested in the "gravelometer" equipment and found to pass 300 pints of gravel showing excellent abrasion. It also passed the standard automotive Tabor test with excellent results. It had outstanding flexural modulus so that it could be installed more easily with less labor on the vehicle assembly line.

Example 7

A seventh sample was prepared at 1200 gsm using the following blend: (i) 20% of 6d×3" polyester heat set to 175° C. (NwN Z201); (ii) 20% of 15d×3" polyester heat set to 175° C. (NwN Z202); (iii) 20% of 3d×2" polyester heat set to 175° C. (NwN Z203); (iv) 30% of 4d×2" bi-component copolymer fibers with a PET internal core (Huvis); and (v) 10% of 1.5d×1.5" PLA fibers (NwN 2438). After blending this fourth sample was heated at 210° C. for 30 seconds, placed in cold mold for 60 seconds, and then trimmed to the shape of underbody aero shield.

After aging at 90° C. for 24 hours, the sample showed no distortion. Water was not absorbed into the fabric during testing with 3 mL of water. Trim scrap was recyclable back into PET pellets. This seventh sample desirably showed adequate flexural modulus and improved noise reduction.

There was a 50% reduction in cycle time of the seventh sample as compared to the sixth sample. This seventh sample was tested in the gravelometer equipment and was found to pass 200 pints of gravel showing excellent abrasion. This sample also passed the standard automotive Tabor test with excellent results.

Example 8

An eighth sample was prepared at 1350 GSM using the same blend as the seventh sample set forth above. The fabric was needle punched to a thickness of 15 mm. During blending, a fluorocarbon finish (Goulston Technologies; FC L624) was applied at the rate of 0.20% on weight of fiber; and an inorganic phosphate salt finish (Lurol; FR-L987) was added at 0.5% by weight of fiber. Once blended and finished, this eighth sample was heated at 210° C. for 60 seconds, placed in cold mold for 60 seconds, and then trimmed to the shape of an underbody aero shield.

After aging at 90° C. for 24 hours, the sample showed no distortion. Water was not absorbed into the fabric during testing with 3 mL of water. Trim scrap was recyclable back into PET pellets. Desirably, this eighth sample showed excellent flexural modulus and improved noise reduction.

Example 9

A ninth sample was prepared at 1600 GSM with the following blend: (i) 50% of 6d×3" black polyester heat set to 185° C. (Z258P); (ii) 15% of 6d×3" black polyester with Phosphate FR, heat set to 185° C. (Z2546); (iii) 25% of 4d×2" PETG fibers with a 160° C. melt point (Z2708); and (iv) 10% of 2.5d×2" PLA fibers with a 175° C. melt point (Z2438). During blending, a fluorocarbon finish (Goulston Technologies; FC L624) was applied at the rate of 0.20% on weight of fiber; and an inorganic phosphate salt finish (Lurol; FR-L14951) was added at 0.5% by weight of fiber. The fabric was needle punched to a thickness of 15 mm. Once blended and finished, this ninth sample was heated at 210° C. for 60 seconds, placed in cold mold for 60 seconds, and then trimmed to the shape of an underbody aero shield.

After aging at 120° C. for 24 hours, the sample showed no distortion. Water was not absorbed into the fabric during testing with 3 mL of water. Trim scrap was recyclable back into PET pellets. Desirably, this ninth sample showed excellent flexural modulus and improved noise reduction.

This ninth sample was also tested in the "gravelometer" equipment and was found to pass 300 pints of gravel showing excellent abrasion. It also passed the standard automotive Tabor test with excellent results. It had outstanding flexural modulus so that it could be installed more easily with less labor on the vehicle assembly line. This ninth sample also showed outstanding resistance to oil, water, anti-freeze, and other engine fluids.

Example 10

A pair of tenth samples were run at 1200 and 1600 gsm respectively with the following blend: (i) 55% of 6d×3" black polyester heat set to 185° C. (Z258P); (ii) 15% of 6d×3" black polyester with Phosphate FR heat set to 185° C. (Z2546); and (iii) 30% of 4d×2" PETG fibers with a 160° C. melt point (Z2708). During blending, a fluorocarbon finish (Goulston Technologies; FC L624) was applied at the rate of 0.20% on weight of fiber; and an inorganic phosphate salt finish (Lurol; FR-L14951) was added at 0.5% by weight of fiber. The fabric was needle punched to a thickness of 15 mm. Once blended and finished, this ninth sample was heated at 210° C. for 60 seconds, placed in cold mold for 60 seconds, and then trimmed to the shape of an underbody aero shield.

After aging at 150° C. for 24 hours, the sample showed no distortion. The finished molded part achieved the V0 designation on the ASTM E-84 flame test. Water was not absorbed into the fabric during testing with 3 mL of water. Trim scrap was recyclable back into PET pellets. Desirably, this tenth sample showed excellent flexural modulus and improved noise reduction.

This tenth sample was also tested in the gravelometer and found to pass 300 pints of gravel showing excellent abrasion. It also passed the standard automotive Tabor test with excellent results. It had outstanding flexural modulus so that it could be installed more easily with less labor on the vehicle assembly line. This tenth sample showed outstanding resistance to oil, water, anti-freeze, and other engine fluids.

Adverting to the drawings FIG. 1 is a graph that illustrates the relationship between normal incidence absorption coefficient and sound frequency. As shown in the graph in FIG. 1, at frequencies above 200 hz the normal incidence absorption coefficient maintains about a constant value as sound frequency increases for a current production LX Aero Production. Samples D, E, and F made using the teachings of the invention show a remarkable increase in absorption coefficient as frequency increases. The absorption coefficient is defined as the relationship between the acoustic energy that is absorbed by a material and the total incident energy impinging upon it. This coefficient should be limited between 0 (not absorbent at all, i.e. reflective) and 1 (totally absorbent).

Figure 2:
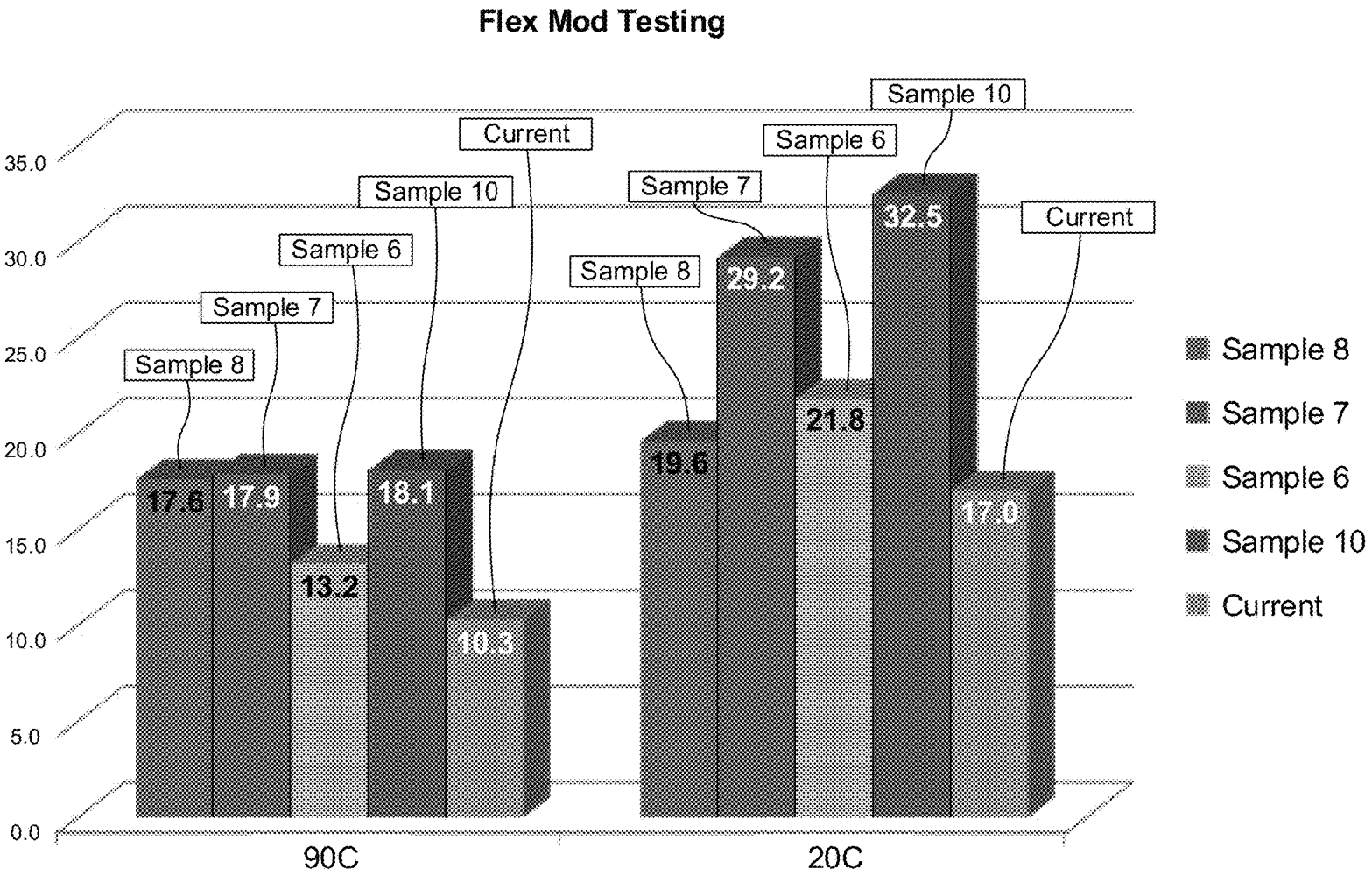
FIG. 2 shows the relationship between the flexural modulus of various moldable fabrics and temperature.

FIG. 2 further illustrates the advantages of the present invention over currently available material. Shown in FIG. 2 is a bar graph that illustrates an additional acoustic property advantage over current state of the art material. Shown in FIG. 2 are samples D, E, and F as compared to the current available material tested. As shown in various testing environments both at ambient temperature (20 C) and elevated temperature (90 C), samples D, E, and F outperformed the current material tested.

FIG. 3 illustrates relative sizes for five fibers used within some of the examples described herein. Shown is a 3, 6 and 15 denier PET fibers. Also illustrated is a 4 denier bicomponent fiber and a 1.5 denier PLA fiber. Smaller deniers are preferred for sound dampening or acoustical impedance purposes as explained below.

The surface area of a non-woven fabric is directly related to the denier and cross-sectional shape of the fibers in the fabric. Smaller deniers yield more fibers per unit weight of the material, higher total fiber surface area, and greater possibilities for a sound wave to interact with the fibers in the fabric structure. Acoustical absorption properties of nonwoven fabrics depend on a variety of variables including fiber geometry and fiber arrangement within the fabric structure. Different structures of fibers result in different total surface areas of nonwoven fabrics. Nonwoven fabrics such as vertically lapped fabrics are ideal materials for use as acoustical impedance or insulation products, because they have a high total surface. Vertically lapped nonwoven technology include for example, but are not limited to, carding, perpendicular layering of the carded webs, and through-air bonding using synthetic binder fibers.

Figure 4:
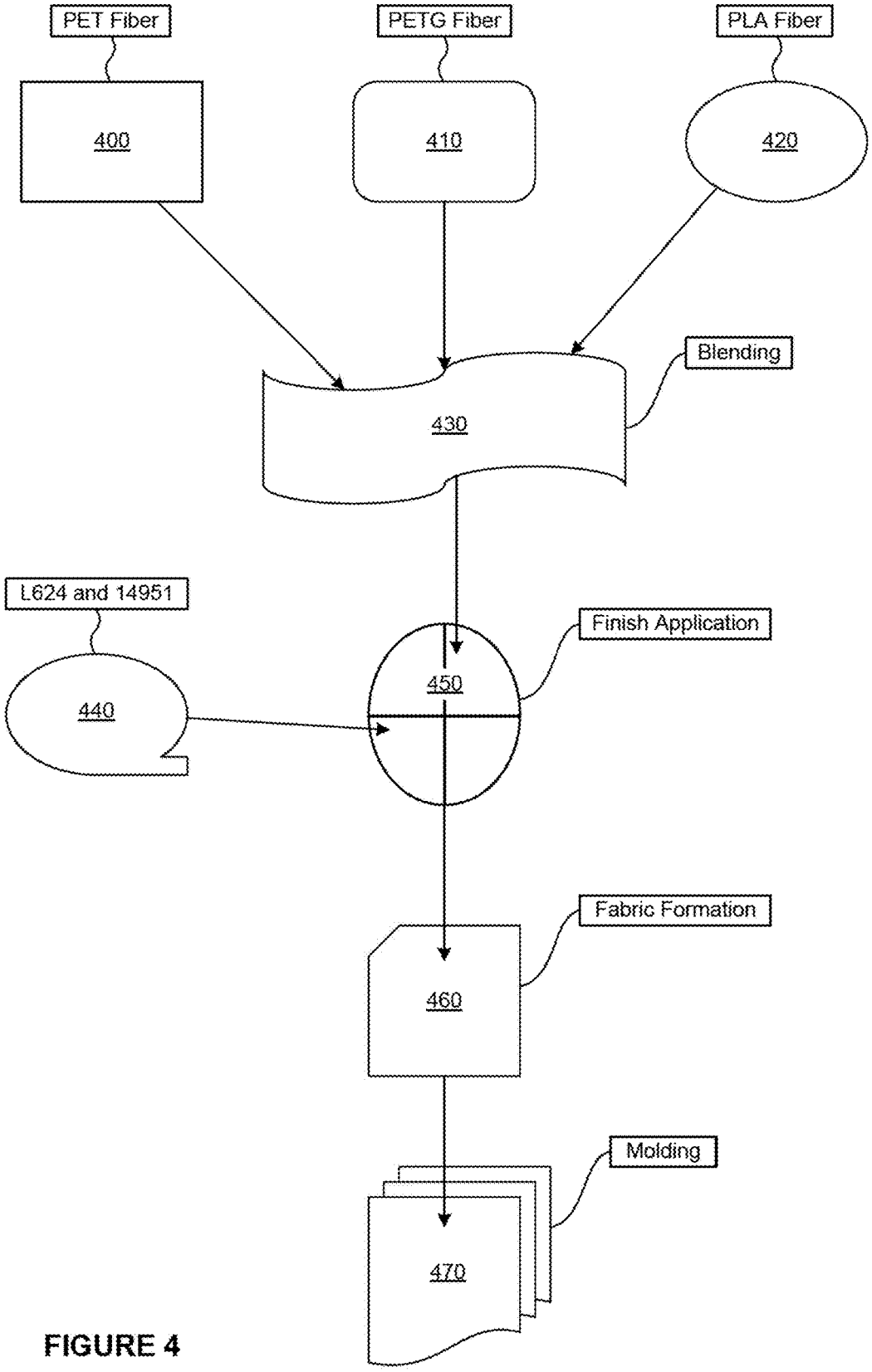
FIG. 4 is a flow diagram illustrating applying finishing material on the composite for heat exposure in automotive applications.

FIG. 4 illustrates a flow diagram for a non-woven fabric. Shown as an example, PET fiber 400, with PETG fiber 410 and PLA fiber 420 is blended in a blending machine 430. A finishing application 450 is accomplished adding additives for example those shown, but not limited to, additives in block 440. A fabric formation 46 is made that may be further molded as a product as shown in molding fabric 470 or utilized as a nonwoven fabric in an extrusion process.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as described by the appended claims.

What is claimed:

1. A moldable automotive fabric with enhanced heat deformation comprising, a plurality of fiber elements that are made from a 100% polyester blend and have a heat deformation temperature between 110° C. and 200° C.;

55% of the polyester blend is a polyethylene terephthalate (PET) that has a heat set of 185 C;

15% of the polyester blend is a polyester treated with a phosphate flame retardant; and 30% of the polyester blend is a polyethylene terephthalate glycol (PETG) that has a 160 C melt point; and a fluorocarbon finish at 0.20% by weight of fiber applied to the 100% polyester blend.

2. The fabric of claim 1, wherein each fiber element has a denier per filament of between 1 to 15.

3. The fabric of claim 1, wherein each fiber element has a maximum length of between 0.5 inches to 6 inches.

4. The fabric of claim 1, wherein the 100% polyester blend is treated with an inorganic phosphate salt finish that does not exceed 0.05% to 1.0% of the fiber weight.

5. The fabric in claim 1, wherein the finish further comprises an antistatic element.

6. A moldable automotive fabric with enhanced heat deformation comprising, a plurality of fiber elements that are made from a 100% polyester blend and have a heat deformation temperature between 110° C. and 200° C.;

50% of the polyester blend is an untreated polyester having a heat set at about 185 C;

15% of the polyester blend is a treated polyester treated with an inorganic phosphate salt finish at 0.5% by weight of fiber and heat set to 185 C;

25% of the polyester blend is a polyethylene terephthalate glycol (PETG) that has a 160 C melt point;

10% is the PLA fibers with a 175 C melt point; and wherein, a fluorocarbon finish is applied at 0.20% fiber weight of fiber to the 100% polyester blend; and the fabric is further needle punched to a thickness of about 15 mm.

7. The fabric of claim 6, wherein the percentage of PLA in the moldable fabric is between 1% to 60% by weight.

8. The fabric of claim 6, wherein each fiber element has a denier per filament of between 1 to 15.

9. The fabric of claim 6, wherein each fiber element has a maximum length of between 0.5 inches to 6 inches.

10. The fabric in claim 6, wherein the fluorocarbon finish further comprises an antistatic element.

* * * * *